US009677352B2

(12) United States Patent
Angelle et al.

(10) Patent No.: US 9,677,352 B2
(45) Date of Patent: Jun. 13, 2017

(54) CHUCK SPIDER

(71) Applicant: Frank's International, LLC, Houston, TX (US)

(72) Inventors: Jeremy Richard Angelle, Lafayette, LA (US); Logan Essex Smith, Youngsville, LA (US); Robert Thibodeaux, Lafayette, LA (US)

(73) Assignee: Frank's International, LLC, Houston, TX (US)

( * ) Notice: Subject to any disclaimer, the term of this patent is extended or adjusted under 35 U.S.C. 154(b) by 331 days.

(21) Appl. No.: 14/296,318

(22) Filed: Jun. 4, 2014

(65) Prior Publication Data

US 2014/0360736 A1 Dec. 11, 2014

Related U.S. Application Data

(60) Provisional application No. 61/831,441, filed on Jun. 5, 2013.

(51) Int. Cl.
*E21B 19/10* (2006.01)

(52) U.S. Cl.
CPC ..... *E21B 19/10* (2013.01)

(58) Field of Classification Search
CPC ..... E21B 19/10; E21B 19/06; E21B 19/164
See application file for complete search history.

(56) References Cited

U.S. PATENT DOCUMENTS 4,015,661 A * 4/1977 Christensen ..... E21B 19/164 166/77.53
4,060,014 A * 11/1977 Turner, Jr. ..... E21B 19/164 81/57.2
4,437,363 A * 3/1984 Haynes ..... E21B 19/164 81/57.18
4,449,596 A 5/1984 Boyadjieff
4,827,808 A * 5/1989 Haynes ..... E21B 19/164 81/57.18
4,869,137 A * 9/1989 Slator ..... B25B 5/147 81/421
5,172,613 A 12/1992 Wesch, Jr.
5,271,298 A * 12/1993 Gazel-Anthoine ... E21B 19/164 81/57.16
5,394,774 A * 3/1995 Dlask ..... E21B 19/164 81/57.18
6,446,524 B1 9/2002 Gravouia
7,810,419 B2 * 10/2010 Rundell ..... B26D 7/02 269/156

(Continued)

OTHER PUBLICATIONS

Examination Report issued in the counterpart British Patent Application No. GB1523084.0, mailed Feb. 29, 2016 (1 page).

(Continued)

*Primary Examiner* — Jennifer H Gay
(74) *Attorney, Agent, or Firm* — Osha Liang LLP

(57) ABSTRACT

An assembly to grip a tubular member in a wellbore includes a main body, a plurality of jaw assemblies, and a cover plate to retain the jaw assemblies within the main body. The main body includes a chuck ring and at least one rotation assembly. The plurality of jaw assemblies are configured to simultaneously engage the tubular member in the wellbore as the chuck ring is rotated in a first direction about an axis of the main body by the at least one rotation assembly.

28 Claims, 13 Drawing Sheets

(56) References Cited

U.S. PATENT DOCUMENTS

| | | | | |
|---|---|---|---|---|
| 8,006,590 | B2 | 8/2011 | Light et al. | |
| 2002/0108748 | A1 | 8/2002 | Keyes | |
| 2008/0022811 | A1* | 1/2008 | Kathan | E21B 19/164 81/57.18 |
| 2009/0272233 | A1 | 11/2009 | Musemeche | |
| 2014/0345426 | A1* | 11/2014 | Rosano | E21B 19/164 81/57.18 |
| 2014/0360736 | A1* | 12/2014 | Angelle | E21B 19/10 166/382 |
| 2015/0101826 | A1* | 4/2015 | Gupta | E21B 19/164 166/377 |
| 2015/0159445 | A1* | 6/2015 | Smith | E21B 19/10 166/382 |

OTHER PUBLICATIONS

International Search Report for corresponding International Application No. PCT/US2014/041047, mailed Sep. 30, 2014 (3 pages).
Written Opinion for corresponding International Application No. PCT/US2014/041047, mailed Sep. 30, 2014 (10 pages).
Office Action issued in Canadian Application No. 2,912,176; mailed Aug. 11, 2016 (3 pages).

* cited by examiner

CHUCK SPIDER

CROSS-REFERENCE TO RELATED APPLICATIONS

This application claims benefit, under 35 U.S.C. §120, of U.S. Provisional Application Ser. No. 61/831,441, filed on Jun. 5, 2013, and entitled "Chuck Spider". The disclosure of this U.S. Provisional Application is incorporated herein by reference in its entirety.

BACKGROUND OF THE DISCLOSURE

Field of the Disclosure

Embodiments disclosed herein generally relate to methods and apparatuses to at least partially grip a tubular member. More specifically, embodiments disclosed herein relate to an apparatus that is used to adjustably grip and support tubular members of varying size as the tubular members are installed to or removed from a downhole well location.

Description of the Related Art

In oilfield exploration and production operations, various oilfield tubular members are used to perform important tasks, including, but not limited to, drilling the wellbore and casing a drilled wellbore. For example, a long assembly of drill pipes, known in the industry as a drill string, may be used to rotate a drill bit at a distal end to create the wellbore. Furthermore, after a wellbore has been created, a casing string may be disposed downhole into the wellbore and cemented in place to stabilize, reinforce, or isolate (among other functions) portions of the wellbore. As such, strings of drill pipe and casing may be connected together, such as end-to-end by threaded connections, in which a female "pin" member of a first tubular member is configured to threadably engage a corresponding male "box" member of a second tubular member. Alternatively, a casing string may be made-up of a series of male-male ended casing joints coupled together by female-female couplers. The process by which the threaded connections are assembled is called "making-up" a threaded connection, and the process by which the connections are disassembled is referred to "breaking-out" the threaded connection. As would be understood by one having ordinary skill, individual pieces (or "joints") of oilfield tubular members may come in a variety of weights, diameters, configurations, and lengths.

Referring to FIG. 1, a perspective view is shown of one embodiment of a drilling rig 101 used to run one or more tubular members 111 (e.g., casing, drill pipe, etc.) downhole into a wellbore. As shown, the drilling rig 101 includes a frame structure known as a "derrick" 102, from which a traveling block 103 (which may include a top drive) suspends a lifting apparatus 105 (e.g., an elevator or a tubular (e.g., casing) running tool connected to the quill of a top drive) and a gripping apparatus 107 (e.g., slip assembly or "spider") at the rig floor may be used to manipulate (e.g., raise, lower, rotate, hold, etc.) a tubular member 111. The traveling block 103 is a device that is suspended from at or near the top of the derrick 102, in which the traveling block 103 may move up-and-down (i.e., vertically as depicted) to raise and/or lower the tubular member 111. The traveling block 103 may be a simple "pulley-style" block and may have a hook from which objects below (e.g., lifting apparatus 105 and/or top drive) may be suspended. Drilling rig 101 can be a land or offshore rig (e.g., drill ship) without departing from the scope of the present disclosure.

Additionally, the lifting apparatus 105 may be coupled below the traveling block 103 (and/or a top drive if present) to selectively grab or release a tubular member 111 as the tubular member 111 is to be raised and/or lowered within and from the derrick 102. As such, the top drive may include one or more guiding rails and/or a track disposed adjacent to the top drive, in which the guiding rails or track may be used to support and guide the top drive as the top drive is raised and/or lowered within the derrick. An example of a top drive is disclosed within U.S. Pat. No. 4,449,596, filed on Aug. 3, 1982, and entitled "Drilling of Wells with Top Drive Unit," which is incorporated herein by reference.

Typically, a lifting apparatus 105 includes movable gripping members (e.g., slip assemblies) attached thereto and movable between a retracted (e.g., disengaged) position and an engaged position. In the engaged position, the lifting apparatus 105 supports the tubular member 111 such the tubular member 111 may be lifted and/or lowered, and rotated if so equipped, e.g., by using a lifting apparatus that is a tubular (e.g., casing) running tool connected to the quill of the top drive. In the retracted position, the lifting apparatus 105 may release the tubular member 111 and move away therefrom to allow the tubular member 111 to be engaged with or removed from the lifting apparatus 105 and/or the gripping apparatus 107. For example, the lifting apparatus 105 may release the tubular member 111 after the tubular member 111 is threadably connected to a tubular string 115 supported by the gripping apparatus 107 (e.g., slip assembly or "spider") at the rig floor at the floor of the drilling rig 101.

Further, in an embodiment in which the drilling rig 101 includes a top drive and a tubular running tool, the tubular member 111 may be supported and gripped by the tubular running tool connected to the quill of the top drive. For example, the tubular running tool may include one or more gripping members that may move radially inward and/or radially outward. In such embodiments, these gripping members of a tubular running tool may move radially outward to grip an internal surface of the tubular member 111, such as with an internal gripping device and/or the gripping members of the tubular running tool may move radially inward to grip an external surface of the tubular member 111, such as with an external gripping device, however so equipped.

As such, the gripping apparatus 107 of the drilling rig 101 may be used to support and suspend the tubular string 115, e.g., by gripping, from the drilling rig 101, e.g., supported by the rig floor 109 or by a rotary table thereof. The gripping apparatus 107 may be disposed within the rig floor 109, such as flush with the rig floor 109, or may extend above the rig floor 109, as shown. As such, the gripping apparatus 107 may be used to suspend the tubular string 115, e.g., while one or more tubular members 111 are connected or disconnected from the tubular string 115.

The illustrated gripping device 201 includes a bowl 203 with a plurality of slip assemblies 205 movably disposed therein. Specifically, the slip assemblies 205 may be connected to a ring 207, in which the ring 207 may be connected to the bowl 203 through an actuator (e.g., actuator rods) 209. Actuator may be actuated, such as electrically actuated and/or fluidly (e.g., hydraulically) actuated, to move up and/or down with respect to the bowl 203, in which the slip assemblies 205 connected to the ring 207 may correspondingly move up and/or down with respect to the bowl 203.

The illustrated slip assemblies 205 are designed to engage and contact the inner tapered surface of the bowl 203 when moving with respect to the bowl 203. Bowl 203 is shown as a continuous surface but may comprise non-continuous surfaces (e.g., a surface adjacent to the rear of each slip assembly 205). Thus, as the slip assemblies 205 move up or down with respect to the bowl 203, the slip assemblies 205 may travel down along an inner surface of the bowl 203. With this movement, an inner surface (e.g., die) of the slip assemblies 205 will grip a tubular member 211 disposed within the gripping device 201. The slip assemblies 205 may have a gripping surface (e.g., teeth) on the inner surface to facilitate the gripping of the tubular member 211. After the tubular member 211 is supported by the gripping device 201, additional tubular members may be connected or disconnected from the tubular member 211.

As shown with respect to FIGS. 2A and 2B, the gripping device 201 may be used to grip tubular members 211 having multiple outer diameters. For example, as shown in FIG. 2A, the slip assemblies 205 may be positioned within the bowl 203 of the gripping device 201 to grip a tubular member 211A having a first diameter D1. As discussed, the slip assemblies 205 may be positioned using the ring 207 that may be vertically movable, e.g., through the actuator rods 209. FIG. 2B shows gripping device 201, in which the slip assemblies 205 are positioned vertically higher within the bowl 203 with respect to the positioning of the slip assemblies 205 shown in FIG. 2A. As such, this positioning of the slip assemblies 205 in FIG. 2B enables the gripping device 201 to grip another tubular member 211B, in which the tubular member 211B has a second outer diameter D2 larger than the first outer diameter D1 of the tubular member 211A (for example, where D1 and D2 are on a tubular body itself and not a connector portion thereof). Thus, gripping device 201 may grip tubular members 211 having a large range of outer diameters without the need of reconfiguration and/or adding supplemental equipment to the gripping device 201. For example, in one embodiment, the second outer diameter D2 may be at least 145 percent larger (or smaller) than the first outer diameter D1.

From time-to-time, the drillstring must be raised or "tripped" out of the hole, such as when changing the drill bit at the end of the string. As the drillstring is brought out of the hole, the various tubular members are removed from the string and set aside in or around the drilling rig. However, when doing this, the tubular members may have drilling fluids and/or debris deposited thereon, such as oil or water-based mud and cuttings from the drilled underground formations.

For example, when drilling downhole, the cuttings formed from the borehole with the drill bit at the bottom of the string may need to be removed from the wellbore, and the well head may need to be maintained at a predetermined hydrostatic pressure. Drilling mud is then pumped down through a bore of the drill pipe where the mud exits the drill bit, and is circulated back uphole in the annular space between the drill pipe and the borehole. As such, as the string of tubular members is brought up and removed from the wellbore, mud, whether oil-based or water-based mud, may cling to the outer surface of the tubular members.

One way to remove drilling mud from the tubular members is to have a drilling rig crew member wash down the tubular members with a hose or the like as the tubular members emerge from the borehole. However, this may lead to a loss of valuable drilling fluid that may otherwise be reused in the drilling process, or may further lead to having mud being cast off and onto the rig floor and/or in the areas of the pipe handling equipment, presenting both concerns related to the safety of the workers and concerns related to the proper maintenance of the equipment in the rig. In addition, water used to clean the tubular members may dilute the drilling fluid in the wellbore and affect the mud weight.

Another way to remove mud from the tubular members is to include a one-piece wiper with the pipe handling equipment, in which the wiper may be used to remove excess mud from tubular members passing through the pipe handling equipment. However, this may lead to the wiper wearing out more rapidly, as the wiper may be engaging and wiping the outer surface of the tubular members when passing the tubular members both downhole and uphole. Furthermore, these wipers may not be readily accessible or removable, and therefore may require a significant amount of downtime within the drilling rig to replace the wipers.

Further, generally a pipe string may be disposed and suspended within a borehole from a drilling rig using a pipe handling apparatus, such as a spider, in which the pipe string may be lengthened step-wise by threadably joining a tubular segment to the proximal end of the pipe string at the rig. The pipe string may be suspended within the drilling rig using a second type of pipe handling apparatus, such as an elevator, that is movably supported from a draw works and a derrick above the spider. As the load of the pipe string is transferred between the spider and the elevator, the spider may be unloaded and then disengaged from the pipe string by retraction of the slips within the spider. The lengthened pipe string may then be lowered further into the borehole using the draw works controlling the elevator. The spider may then again engage and support the pipe string within the borehole and an additional tubular segment may be joined to the new proximal end of the pipe string to further lengthen the pipe string.

Lengthening a pipe string generally involves adding one tubular segment at a time to an existing pipe string. Similarly, reducing the length of a pipe string generally involves a reverse process in which one tubular segment at a time is removed from the existing pipe string. Accordingly, each tubular member disposed downhole and returned back uphole from the well may pass through and be handled by one or more pipe handling apparatuses, such as the spider and/or the elevator. However, after handling a large number of tubular segments and supporting the weight of the pipe string, one or more components of the pipe handling apparatuses may require maintenance to ensure that the pipe handling apparatuses are working properly and will continue to work properly.

As such, to reduce the wear on a pipe handling apparatus, a pipe guide may be disposed adjacent to one or both of the openings of the pipe handling apparatus to ensure that the tubular members being received within the pipe handling apparatus are in proper alignment and position. While, the pipe guides themselves may be subject to wear, such as from hard-banding, misalignments, hang-ups while disposed tubular members downhole or pulling them back uphole, etc, it may be easier to inspect and replace a pipe guide, as compared to inspecting and replacing the entire pipe handling apparatus.

For example, a pipe guide may be disposed adjacent to the top opening and/or the bottom opening of a spider, in which the pipe guides may be replaced as needed. For the top pipe guide of the spider, a visual inspection of the pipe guide may be enough to determine if the top pipe guide needs replacing. However, it may be more complicated to determine if the bottom pipe guide requires replacing, as the bottom pipe guide may be disposed below the rig floor such that visual inspection may be difficult, or impossible for that matter. Accordingly, a need may exist to address one or more of these concerns.

SUMMARY OF THE CLAIMED SUBJECT MATTER

One or more aspects of the present invention are directed to an assembly to grip a tubular member in a wellbore that includes a main body, a plurality of jaw assemblies, and a cover plate to retain the jaw assemblies within the main body. The main body includes a chuck ring and at least one rotation assembly. The plurality of jaw assemblies are configured to simultaneously engage the tubular member in the wellbore as the chuck ring is rotated in a first direction about an axis of the main body by the at least one rotation assembly.

Further, one or more aspects of the present invention are directed to a method to grip a tubular member with a gripping apparatus, the method including positioning the gripping apparatus substantially concentrically about a wellbore, engaging the tubular member through a central bore of the gripping apparatus, activating at least one rotation assembly to rotate a chuck ring of the gripping apparatus in a first direction, simultaneously displacing a plurality of jaw assemblies radially toward the central bore with a helical groove of the chuck ring, and rotating the chuck ring until dies of each of the plurality of jaw assemblies engage an outer profile of the tubular member.

Furthermore, one or more aspects of the present invention are directed to an assembly to grip a tubular member in a wellbore, the assembly including a main body comprising a chuck ring and at least one means for rotating the chuck ring, a plurality of extendable means for gripping the tubular member, and a cover plate to retain the extendable means for gripping within the main body, in which the plurality of means for gripping the tubular are configured to simultaneously engage the tubular member as the chuck ring is rotated in a first direction about an axis of the main body by the means for rotating.

BRIEF DESCRIPTION OF DRAWINGS

Features of the present disclosure will become more apparent from the following description in conjunction with the accompanying drawings.

DETAILED DESCRIPTION

Figure 1:
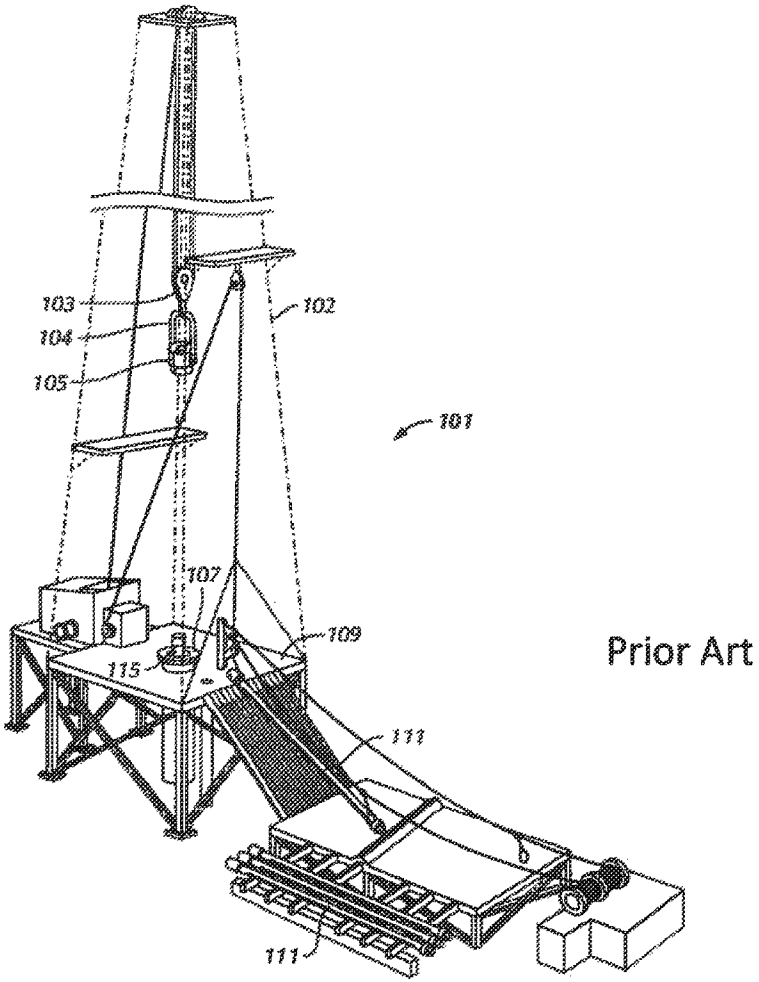
FIG. 1 is a schematic view of a drilling rig.
Figure 2A:
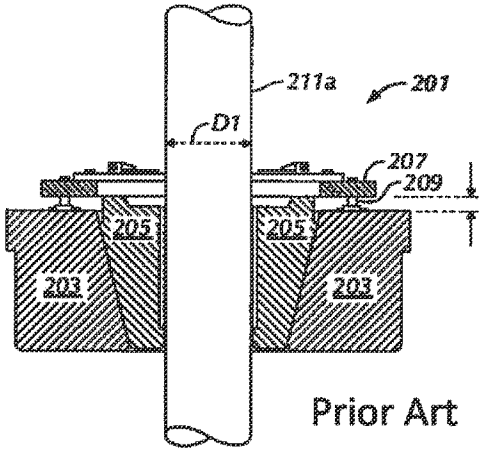
FIGS. 2A and 2B show perspective views of a gripping apparatus disposed within a drilling rig.
Figure 2B:
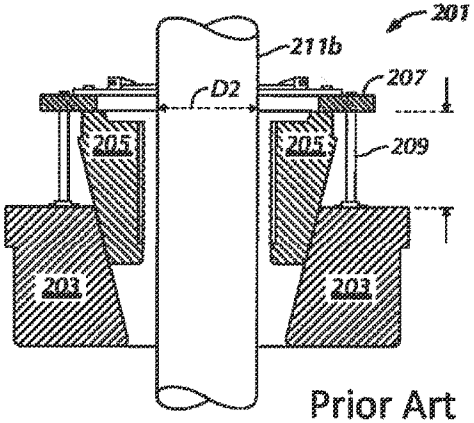

Specific embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the invention. However, it will be apparent to one of ordinary skill in the art that the embodiments disclosed herein may be practiced without these specific details. In other instances, well-known features have not been described in detail to avoid unnecessarily complicating the description.

Furthermore, those having ordinary skill in the art will appreciate that when describing connecting a first element to a second element, it is understood that connecting may be either directly connecting the first element to the second element, or indirectly connecting the first element to the second element. For example, a first element may be directly connected to a second element, such as by having the first element and the second element in direct contact with each other, or a first element may be indirectly connected to a second element, such as by having a third element, and/or additional elements, connected between the first and second elements.

Additionally, directional terms, such as "above," "below," "upper," "lower," "top," "bottom," etc., are used for convenience in referring to the accompanying drawings. In general, "above," "upper," "upward," "top," and similar terms refer to a direction toward the earth's surface from below the surface along a borehole, and "below," "lower," "downward," "bottom," and similar terms refer to a direction away from the surface along the borehole, i.e., into the borehole, but is meant for illustrative purposes only, and the terms are not meant to limit the disclosure.

Figure 3:
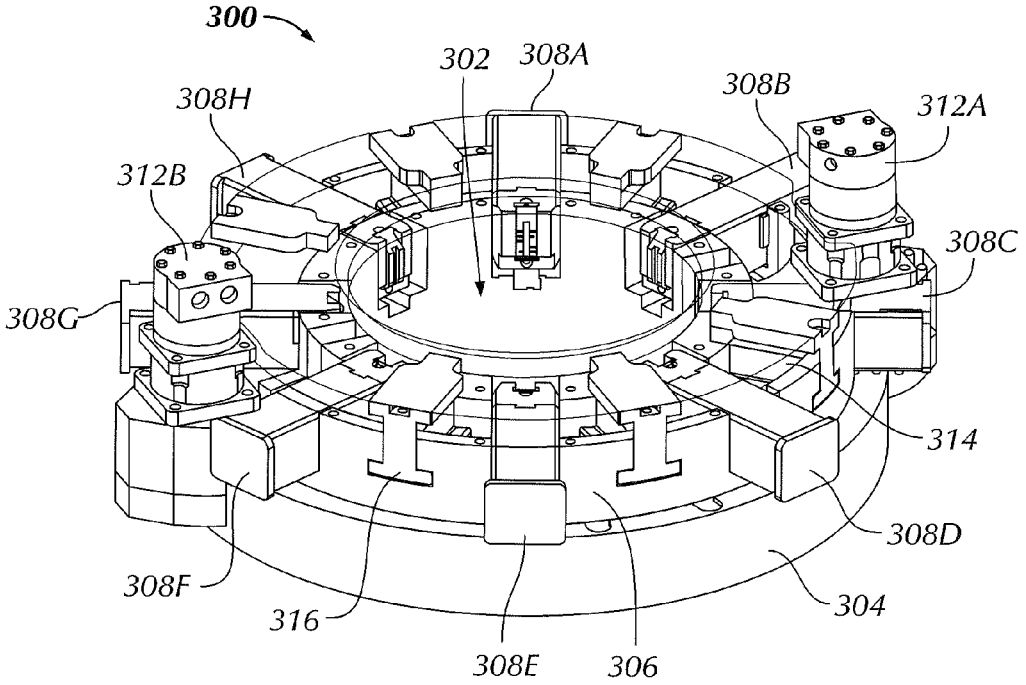
FIG. 3 is a perspective view of a gripping apparatus in accordance with one or more embodiments of the present disclosure.

Referring initially to FIG. 3, an improved gripping assembly 300 in accordance with one or more embodiments disclosed herein is shown. While gripping assembly 300 is depicted in FIG. 3 as a spider apparatus, those having ordinary skill will understand that gripping assembly 300 may be constructed as an elevator apparatus without significant modification or departing from the claimed invention. As disclosed, gripping assembly 300 is constructed as a "chuck spider," in that engagement of jaws of gripping assembly 300 into and out of a central bore 302 is infinitely adjustable from fully retracted to fully engaged, similar to a chuck of a machinists lathe or a handheld power drill. In operation, an adjustment or chuck ring is rotated by one or more pinion gears such that a plurality of jaws adjustably connected thereto may be simultaneously engaged into and out of bore 302 as the chuck ring is rotated in opposite directions.

Referring still to FIG. 3, gripping assembly 300 is constructed as a spider that may, in selected embodiments, be placed directly upon the rig floor (e.g., 109 of FIG. 1) or upon a rig's rotary table such that central bore 302 aligns or is proximate to the central axis of a wellbore below. Gripping assembly 300 may be positioned upon the rig floor and used to secure and/or retain a string of oilfield tubulars (e.g., drill pipe, casing, coiled tubing, etc.) being installed or retrieved from the wellbore below. As shown, gripping assembly 300 may be constructed including a base ring 304, a main body 306, a plurality of extendable and retractable jaws 308, a chuck ring 310 (visible in FIGS. 4-6), one or more rotation assemblies 312, a cover plate 314, and a plurality of cover plate retainers 316.

Figure 4A:
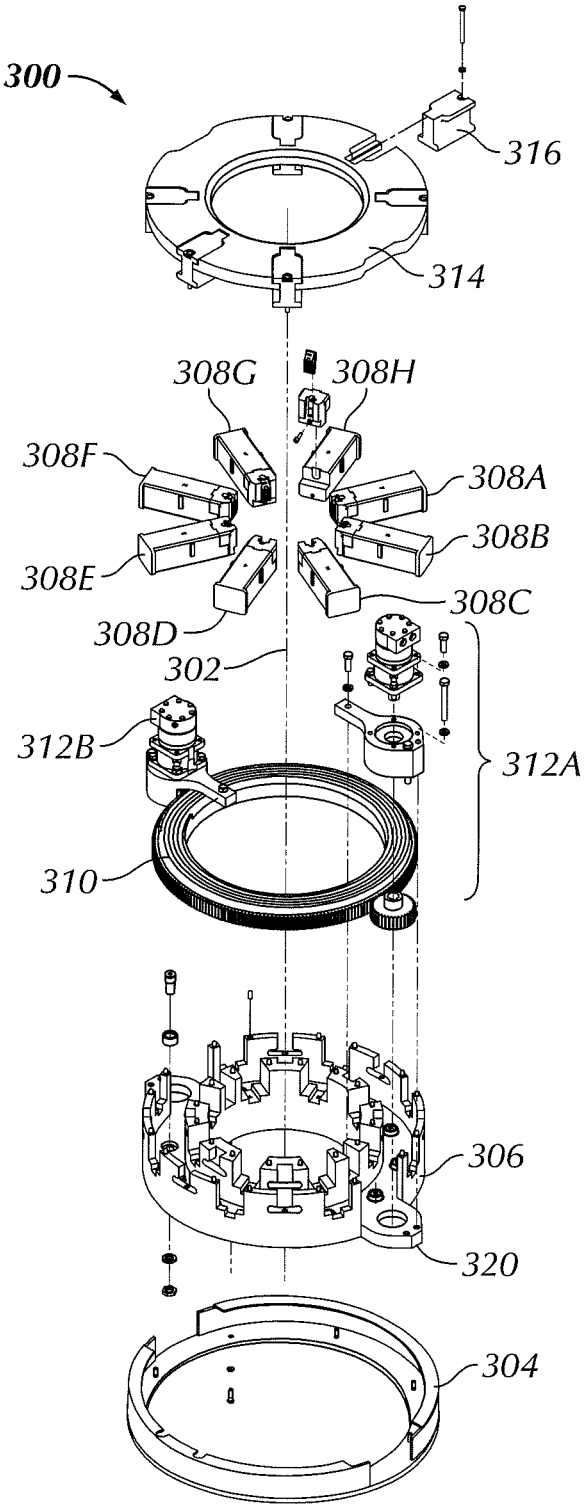
FIGS. 4A-4G are exploded view drawings detailing the components of the gripping apparatus of FIG. 3.
Figure 4B:
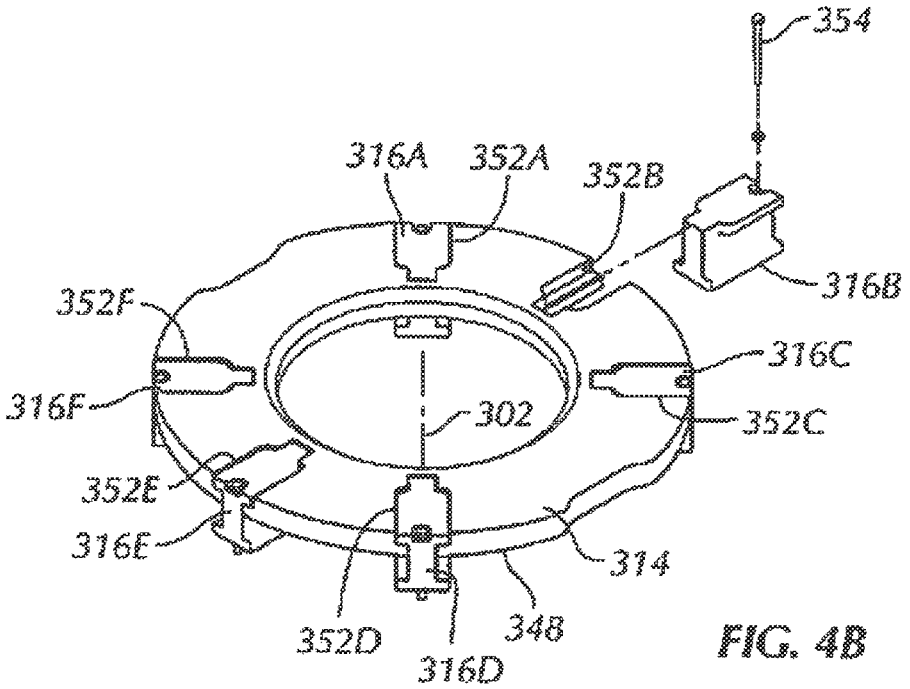
Figure 4C:
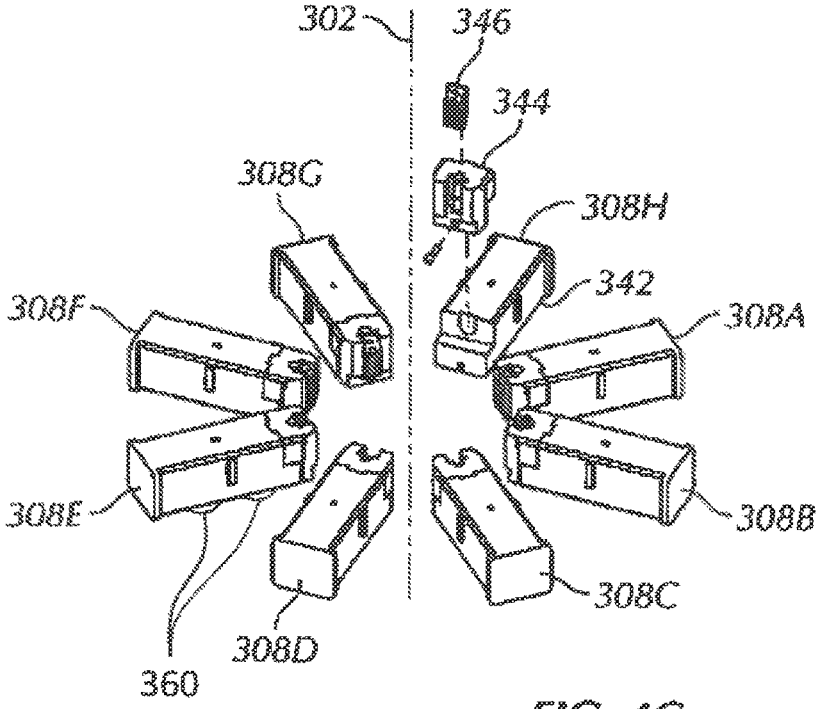
Figure 4D:
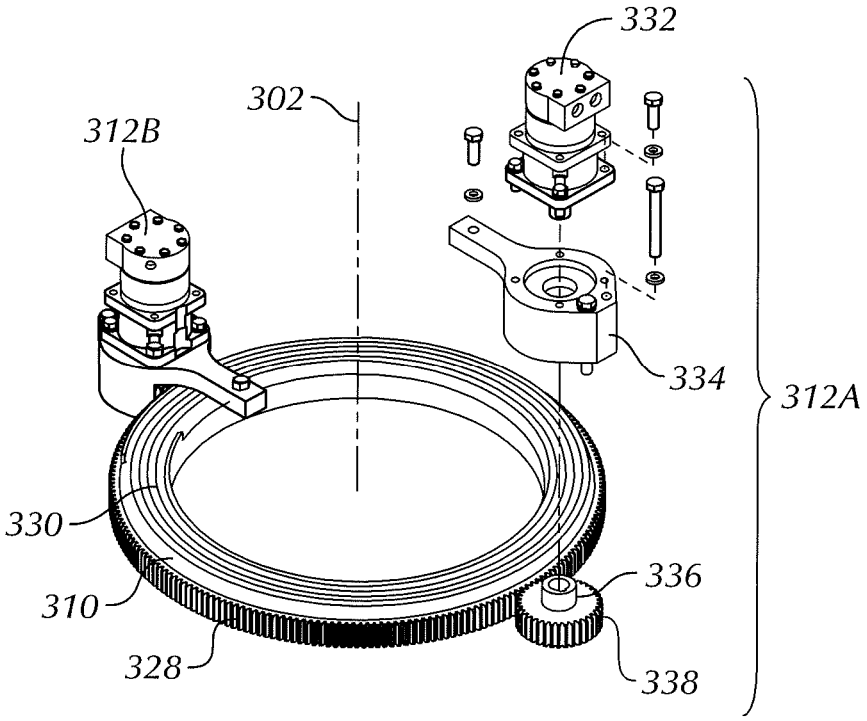
Figure 4E:
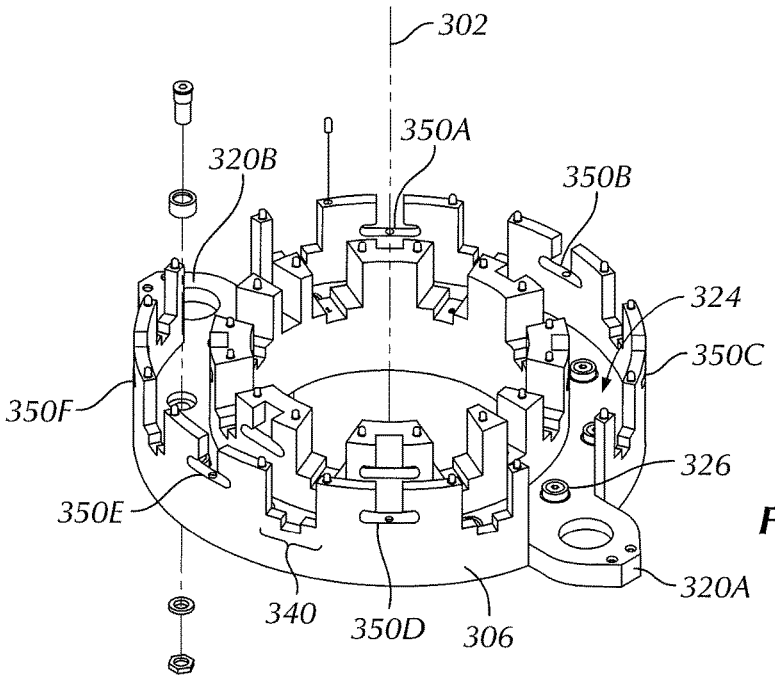
Figure 4F:
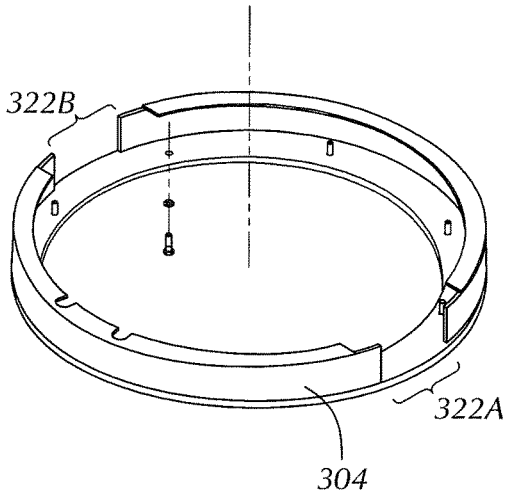
Figure 5:
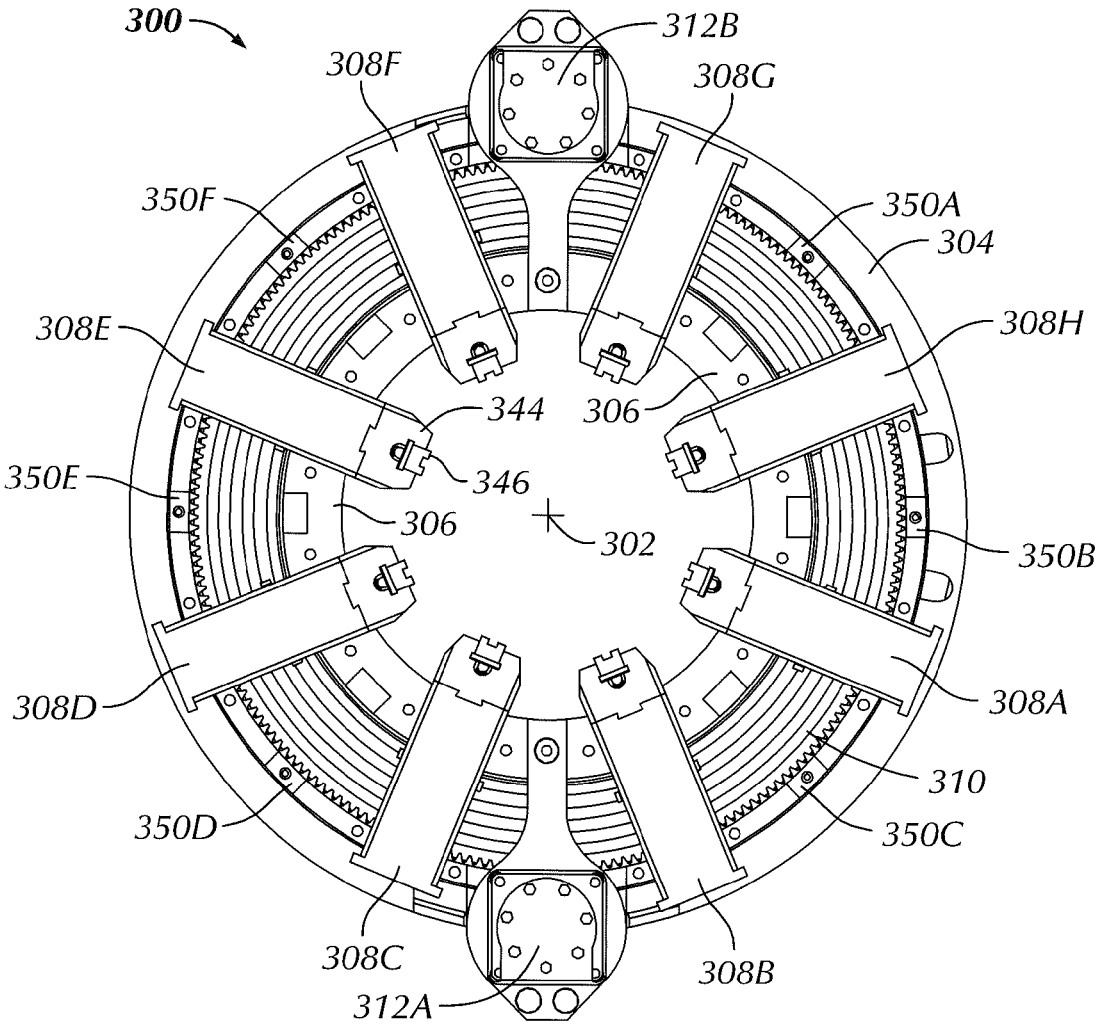
FIG. 5 is a top view drawing of the gripping apparatus of FIG. 3 shown with the top cover and retainers removed.

Referring now to FIGS. 4A-4F and 5 together, the assembly and construction of gripping assembly 300 can be described. In particular, FIG. 4A is an exploded-view drawing of the entire gripping assembly 300, with FIGS. 4B-4F being close-up representations of each primary component, namely cover plate 314 (FIG. 4B), plurality of jaw assemblies 308 (FIG. 4C), chuck ring 310 and rotation assemblies 312 (FIG. 4D), main body 306 (FIG. 4E), and base ring 304 (FIG. 4F). Referring again to FIGS. 4A-F together, gripping assembly 300 is assembled by placing base ring 304 upon a surface and concentrically engaging main body 306 therein such that rotation assembly mounts 320A and 320B (collectively referred to as 320) of main body 306 are located and positioned within relief cuts 322A and 322B (collectively 322) of base ring 304. FIG. 5 depicts a top view of a partially assembled gripping assembly 300 with the cover plate 314 and cover plate retainers 316 removed.

With main body 306 secured within base ring 304, chuck ring 310 may be installed to a circumferentially profiled groove 324 within main body 306. As shown, a plurality of spherical bearings 326 are positioned within groove 324 to allow chuck ring to freely rotate with respect to main body 306 upon bearings 326. However, as would be understood by those having ordinary skill, various other forms of bearing assemblies, including tapered and straight roller bearings, ball bearings, needle bearings, thrust bearings, and friction journals may be used in place of or in combination with spherical bearings 326. As shown (particularly in FIG. 4D), chuck ring 310 is shown as a generally ring-shaped body that includes gear teeth 328 on its outer periphery and a helical groove 330 upon its top surface.

With chuck ring 310 positioned within groove 324 of main body 306, one or more rotation assemblies 312A and 312B (312, collectively) are installed to mounts 320A and 320B of main body 306. As shown, rotation assemblies 312 each include a rotation motor 332, a main body 334, and a pinion gear 336 having outer teeth 338 corresponding to teeth 328 of chuck ring 310. Rotation motor 332 is depicted as an electric motor, but it should be understood that any form of drive mechanism including, but not limited to, hydraulic motors, pneumatic motors, and the like may be used as well. Additionally, while gripping assembly 300 is shown having two rotation assemblies, 312A and 312B, it should be understood that the number and type of rotation assemblies used to rotate chuck ring 310 with respect to main body 306 may change without departing from the scope of the claimed subject matter.

Referring again to FIGS. 4A-4F and 5 together, the plurality of jaw assemblies 308A-308H (collectively, 308) may be installed atop the chuck ring and into cutouts 340 of main body 306. While gripping assembly 300 is shown as having eight jaw assemblies labeled 308A-308H, it should be understood that gripping assembly 300 may comprise fewer (e.g., 3-7) or more (e.g., 9-16) jaw assemblies 308 depending on the diameter, weight, and configuration of tubular member to be retained within bore 302. As shown, each jaw assembly 308 comprises a jaw body 342, a carrier 344, and a die 346 comprising a plurality of hardened gripping teeth configured to "bite" into and retain an outer profile of a tubular within bore 302. As shown, carrier 344 and die 346 are constructed such that they may be easily replaces should different configurations be preferred or in the event they become worn or broken. As will be discussed further below, in one or more embodiments, a slip (e.g., the jaw assembly 308) may include a jaw body 342 and a carrier 344, and the carrier 344 may be configured to receive the die 346, in which the die 346 forms a textured surface of the slip. Further, in one or more embodiments, the carrier 344 and the die 346 may be integrally formed together. Further, as will be discussed further below, in one or more embodiments, the jaw body 342 and the carrier 344 may be integrally formed together forming a solid slip design.

Additionally, each jaw assembly 308 is configured to slide into and out of cutouts 340 so that dies 346 may engage and disengage tubulars positioned within bore 302 as chuck ring 310 is rotated in the clockwise and counter-clockwise directions. To facilitate this engagement and disengagement, each jaw assembly 308 comprises an upset feature 360 (shown in FIG. 4C) adjacent to and configured to engage the helical groove 330 of chuck ring 301 so that radial movement (and therefore biting force) of dies 346 into and out of engagement with a tubular contained within bore 302 may be accomplished as chuck ring 310 is rotated in opposite directions. While chuck ring 310 and jaw assemblies 308 are shown constructed such that clockwise rotation of chuck ring 310 extends jaw assemblies 308 further into bore 302 and counter-clockwise rotation extends jaw assemblies 308 from bore 302, it should be understood that and relation of rotation between chuck ring 301 and jaw assemblies 308 may be used. Regardless of mode of operation, jaw assemblies 308 are configured to drive into and out of bore 302 of gripping assembly 300 simultaneously, and with infinitely variable positioning (and force application) between their maximum retracted and maximum engaged states.

With jaw assemblies 308 installed to their respective cutouts 340 of main body 306, they may be maintained in position within cutouts 340 by cover plate 314 and plurality of cover plate retainers 316. Referring again to FIGS. 4A-4F and 5 together, cover plate 314 may be placed atop gripping assembly 300 such that a bottom surface 348 of cover plate 314 sits atop the plurality of jaw assemblies 308, thereby preventing them from leaving cutouts 340 of main body 306 from above. As shown, a plurality of six cover plate retainers 316A-316F (collectively 316) radially and simultaneously engage a plurality of slots 350A-350F (collectively, 350) in main body 306 and a plurality of slots 352A-352F (collectively, 352) in cover plate 314. While six cover plate retainers 316 are shown, it should be understood that fewer or more than six cover retainers may be used. With cover place 314 in position, each cover plate retainer (e.g., 316A) may be slid into place (radially toward bore 302) so that slots (e.g., 350A and 352A) are simultaneously engaged, preventing cover plate 314 from being displaced or removed from its position within main body 306 and atop chuck ring 310. A bolt 354 or other fastener mechanism may be used to prevent retainers 316 from disengaging slots 350 and 352 undesirably.

Additionally, while the system of using cover plate 314 and cover plate retainers 316 in conjunction with slots 350 of main body 306 and slots 352 of cover plate 314 are depicted as useful at retaining jaw assemblies 308 within main body 306, the simplified mechanism of using retainers 316 and slots 350 and 352 advantageously has the added benefit of allowing rapid access to the inner workings of gripping assembly 300 with minimal effort or tooling. For example, by quickly and easily removing cover plate 314 and retainers 316, jaw assemblies 308 may be replaced with a set having different a different tubular size engagement range, a set having different configuration of teeth for dies 346, or may be replaced with a renewed or repaired set of jaw assemblies 308. For example, a particular set of jaw assemblies may comprise dies 346 optimized for a particular type and configuration of casing or drill pipe, or for a particular range of tubular diameters. Having the ability to quickly and relatively easily replace jaw assemblies 308 or dies 346 would be highly advantageous in environments where downtimes are to be minimized at all opportunities.

Figure 4G:
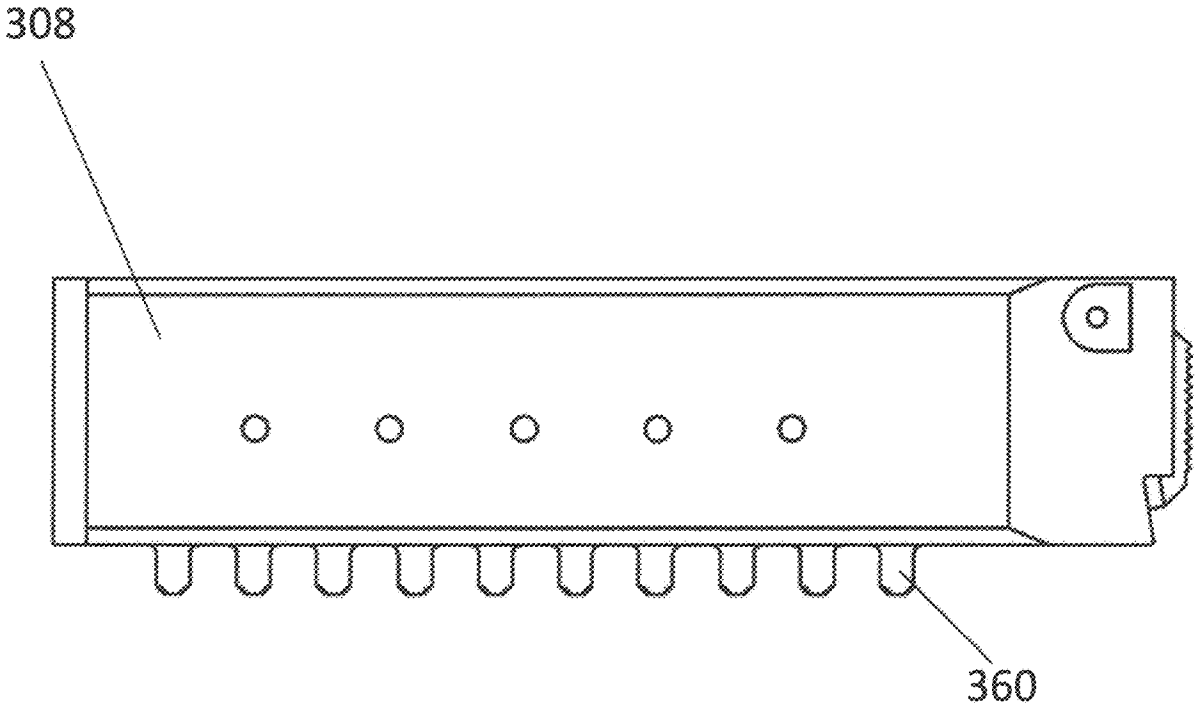

Additionally still, jaw assemblies 308 may be constructed having more than one upset feature 360, as seen by FIG. 4G, to engage the helical groove 330 of chuck ring 310 so that a single set of jaw assemblies 308 may be used to grip more than one range of tubular within central bore 302. For example, in one embodiment, a plurality of jaw assemblies 308 may be sized and configured to grip drill pipe between 10-15cm (4-6 inches) in diameter, whereas another set of jaw assemblies 308 may be sized to grip drill pipe between 15-30cm (6-12 inches) in diameter. In such a circumstance, a plurality of jaw assemblies 308 may be constructed such that a first upset feature may engage chuck ring 310 such that tubulars sized between 10-15cm may be gripped, while a second upset feature (i.e., one that is radially spaced radially from central bore 302 apart from the first upset feature) engages chuck ring 310 such that larger tubulars may be gripped. Further, in one or more embodiments, the gripping assembly 300 may grip drill pipe that is up to 45-55cm (20 inches) in diameter or larger. As such, an operator may adjust the gripping range of the gripping assembly 300 by removing cover plate 314 and retainers 316, adjusting jaw assemblies from one upset feature to another, and replacing the cover plate 314 and retainers 316. Therefore, a single gripping assembly 300 may accommodate multiple ranges of tubulars in bore 302 without the need to keep a separate set of jaw assemblies for each size range. However, it should. be understood that in order to accommodate the largest variety of tubular sizes, multiple sets of jaw assemblies 308 (i.e., each having one or more sets of upset features) may still be used.

Figure 6A:
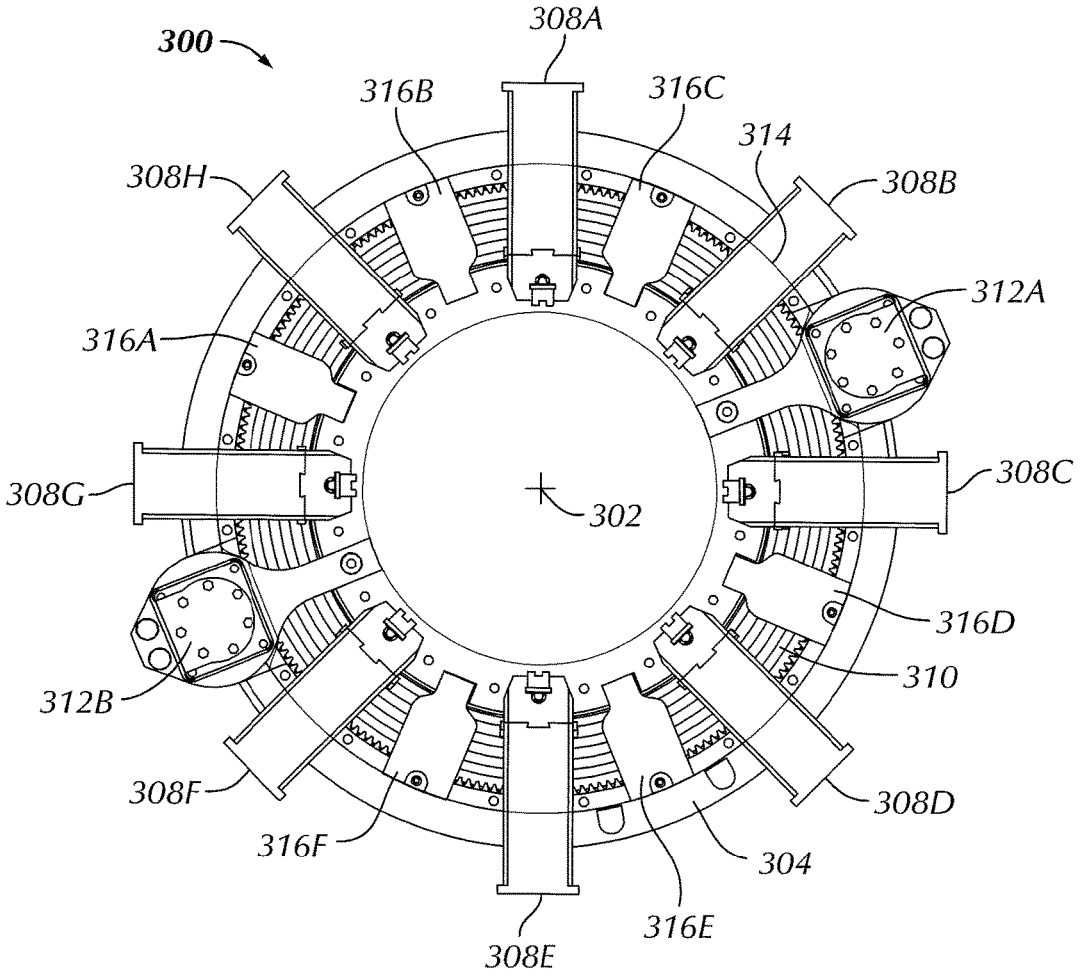
FIGS. 6A and 6B are top view drawings of the gripping apparatus of FIG. 3 shown in an open position (6A) and a closed position (6B).
Figure 6B:
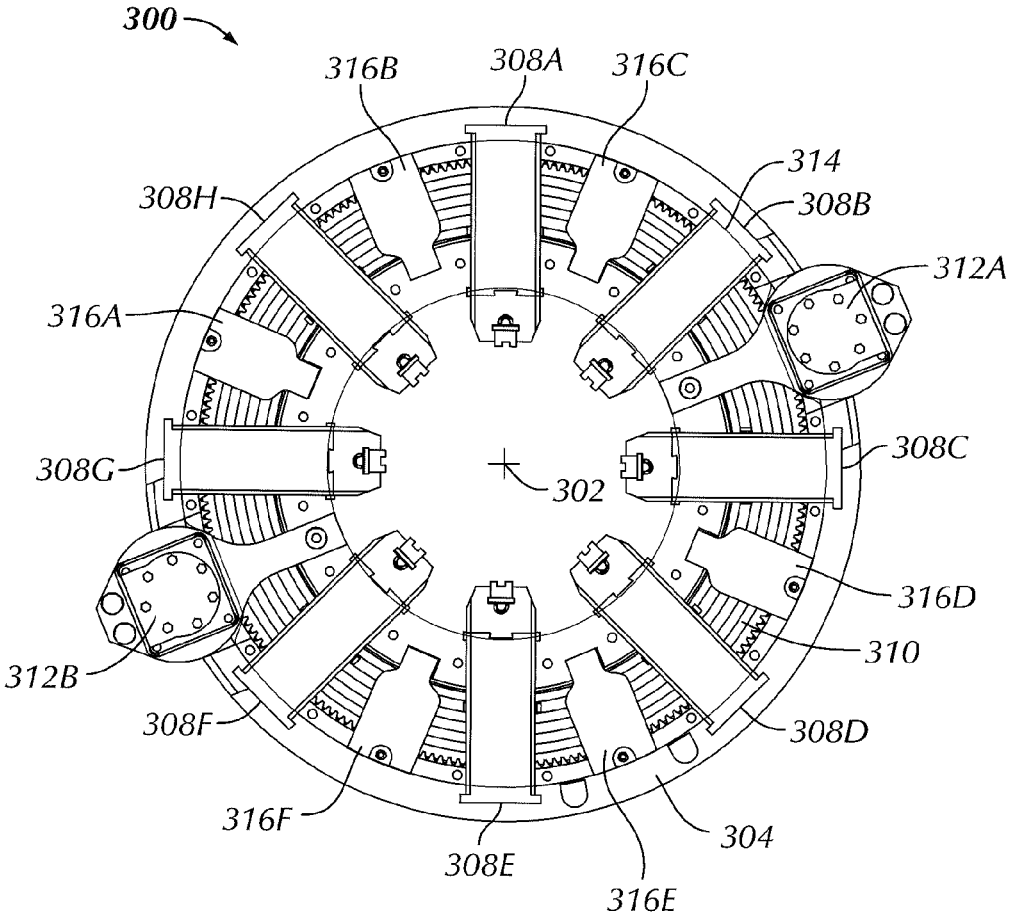

Referring now to FIGS. 6A and 6B, the operation of gripping assembly 300 may be described. FIGS. 6A and 6B show gripping assembly 300 fully assembled in a retracted (6A) and an engaged (6B) position but, for the purpose of clarity, cover plate 314 is shown translucent so that other components may be viewed. To move jaw assemblies 308 from their retracted position to their engaged position, rotation assemblies 312 are energized such that their respective pinion gears 336 are rotated, imparting a rotary drive force to chuck ring 310 through corresponding teeth 338 and 328. As chuck ring 310 is rotated, the helical groove 330 of chuck ring rotates in a spiral fashion, thereby applying a radial displacement simultaneously to each of the plurality of jaw assemblies 308 through the upset portion. Because each of the plurality of jaws engages (or disengages) the central bore 302 at a constant rate for a particular rotation of chuck ring 310, any tubular contained therein will be substantially centered within bore 302 and within gripping assembly 300. With tubular substantially centered within bore 302 of gripping apparatus 300 and with jaw assemblies 308 fully engaged with tubular, chuck ring 310 may be rotated a selected amount further to "bite" or securely retain the tubular contained thereby. Once so engaged, rotation assemblies 312 may be locked (electrically or otherwise) in place so that reverse rotation of the chuck ring 310 (and therefore release of the tubular) may be prevented. When it is desired to release the tubular, rotation assemblies 312 may be unlocked or otherwise backed-off, thereby allowing rotation of chuck ring 310 and retraction of jaw assemblies 308 radially away from bore 302 and any tubular retained therein.

Figure 7:
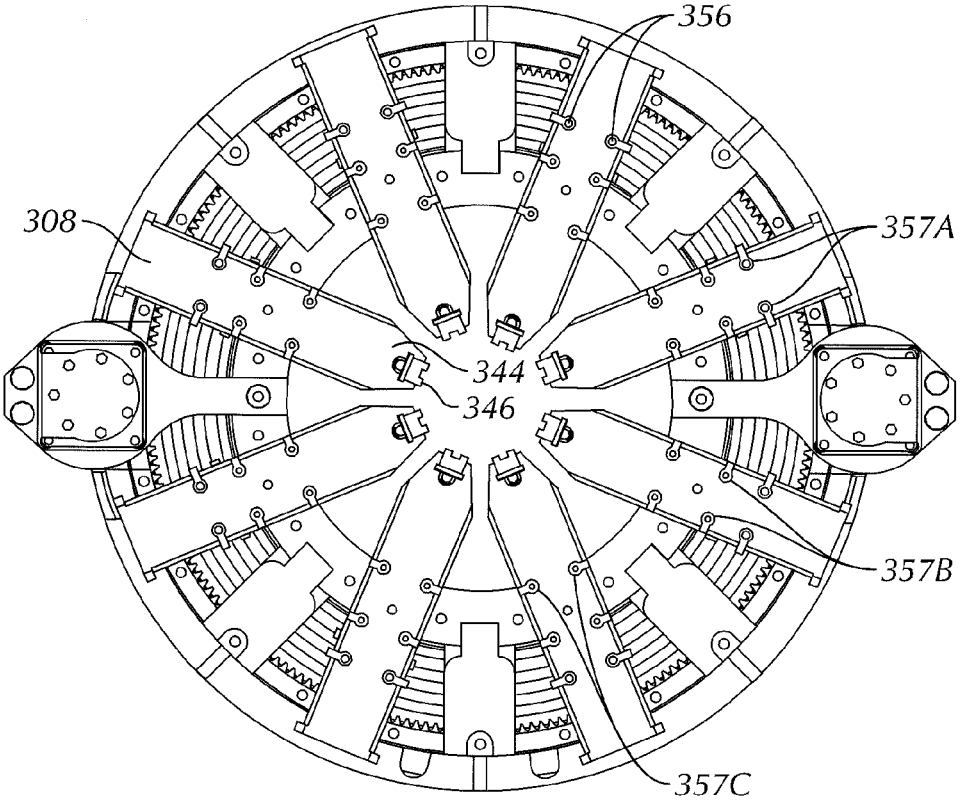
FIG. 7 is a top view drawing of a gripping apparatus in accordance with one or more embodiments of the present disclosure in a closed position.

Referring to FIG. 7, a top view of a gripping assembly 300 in accordance with embodiments disclosed herein is shown. In one or more embodiments, a slip (e.g., the jaw assembly 308) may include a jaw body 342 and a carrier 344, and the carrier 344 may be configured to receive the die 346. In one or more embodiments, the jaw body 342 and the carrier 344 may be integrally formed together. As shown, the jaw body 342 and the carrier 344 may be integrally formed together such that the jaw body 342 and the carrier 344 are a solid piece and make up a solid slip design. Furthermore, in one or more embodiments, each of the jaw body 342, the carrier 344, and the die 346 may all be integrally formed together and may make up a solid slip design. However, in one or more embodiments, a slip may not necessarily include the die 346. In one or more embodiments, a slip may be configured to receive the die 346, in which the die 346 forms a textured surface of the slip. For example, in one or more embodiments, the carrier 344 and the slip holding the die 346 may be integrally formed together and may make up a solid slip design, and the dies 346 may be inserts that may be removable from the solid slip design. In one or more embodiments, the slips may be configured to receive the dies 346, and the dies 346 may form a textured surface of the slips.

Further, in one or more embodiments, one or more stops 356 may be formed or disposed in the slips to limit the stroke of the slip. For example, in one or more embodiments, one or more sets of slots (e.g., 357A, 357B, and 357C) may be formed in a portion of each slip (e.g., in a portion of each jaw assembly 308), in which each of the slots are configured to receive one or more of the stops 356. For example, as shown, the stops 356 are disposed within a first set of slots 357A. In one or more embodiments, the stops 356 may allow a single set of slips to handle tubular pipe of various diameters disposed in the main body of the assembly without the need for additional components added to the assembly. As shown, the engagement between the stops 356 and the first set of slots 357A may limit the stroke length of the slips, and limiting the stroke length of the slips may determine the diameter of tubular pipe that may be accommodated by the slips. For example, in one or more embodiments, the stops may allow the slips (e.g., the jaw assemblies 308) to be able to reach from 18 inches in diameter to 6⅝ inches in diameter without the need for additional components to the assembly. In one or more embodiments, the stops 356 may be engaged with a second set of slips 357B. Alternatively, in one or more embodiments, the stops 356 may be engaged with a third set of slips 357C. In one or more embodiments, more sets of slots configured to engage the stops 356 may be formed in a portion of each slip. However, in one or more embodiments, the stops 356 may be removed from the assembly, which may allow the slips to travel through the entire stroke.

Figure 8:
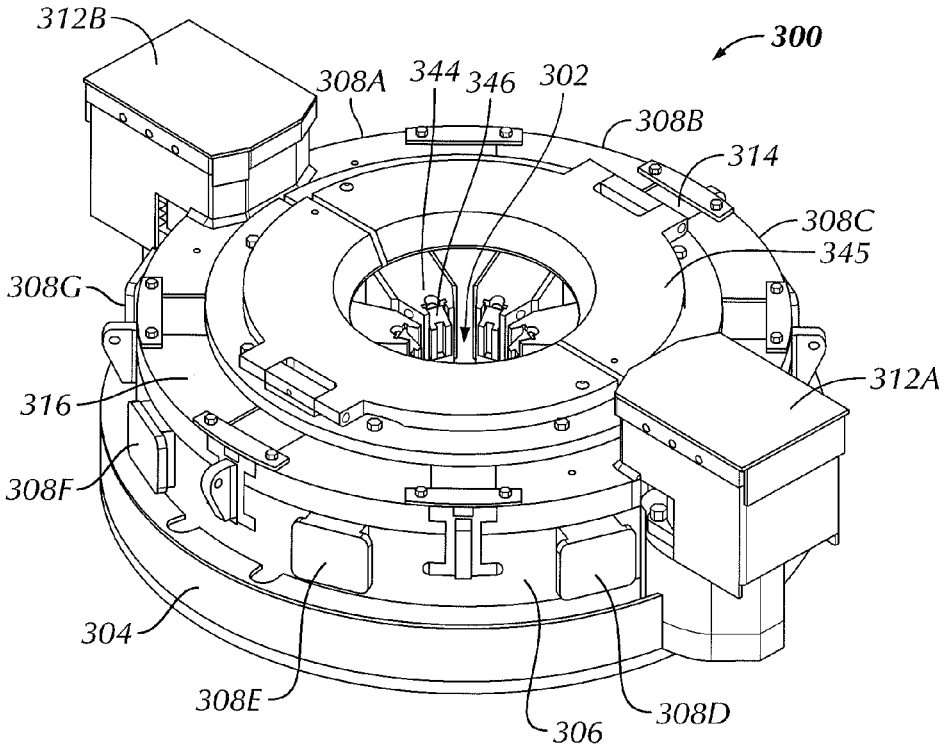
FIG. 8 is a perspective view of a gripping apparatus in accordance with one or more embodiments of the present disclosure.

Referring now to FIG. 8, a gripping assembly 300 in accordance with one or more embodiments disclosed herein is shown. In one or more embodiments, gripping assembly 300 is constructed as a spider that may, in selected embodiments, be placed directly upon the rig floor (e.g., 109 of FIG. 1) or upon a rig's rotary table such that central bore 302 aligns or is proximate to the central axis of a wellbore below. Gripping assembly 300 may be positioned upon the rig floor and used to secure and/or retain a string of oilfield tubulars (e.g., drill pipe, casing, coiled tubing, etc.) being installed or retrieved from the wellbore below. As shown, gripping assembly 300 may be constructed including a base ring 304, a main body 306, a plurality of extendable and retractable jaws 308 (e.g., 308A-308G), a chuck ring 310 (visible in FIGS. 4-6), one or more rotation assemblies 312 (e.g., 312A and 312B), a cover plate 314, a plurality of cover plate retainers 316, and a pipe guide 345.

While the disclosure has been presented with respect to a limited number of embodiments, those skilled in the art, having benefit of this disclosure, will appreciate that other embodiments may be devised which do not depart from the scope of the present disclosure. Accordingly, the scope of the invention should be limited only by the attached claims.

What is claimed is:

1. An assembly to grip a tubular member in a wellbore, the assembly comprising:

a main body comprising a chuck ring and at least one rotation assembly;

a plurality of jaw assemblies; and a cover plate to retain the plurality of jaw assemblies within the main body, wherein the main body further comprises a plurality of cutouts to receive each of the jaw assemblies;

wherein the plurality of jaw assemblies are configured to simultaneously engage the tubular member in the wellbore as the chuck ring is rotated in a first direction about an axis of the main body by the at least one rotation assembly.

2. The assembly of claim 1, wherein the plurality of jaw assemblies are configured to simultaneously disengage the tubular member in the wellbore as the chuck ring is rotated in a second direction about the axis of the main body by the at least one rotation assembly.

3. The assembly of claim 1, further comprising a plurality of cover plate retainers to secure the cover plate to the main body.

4. The assembly of claim 3, wherein each of the plurality of cover plate retainers are configured to radially and simultaneously engage slots of the cover plate and the main body.

5. The assembly of claim 1, wherein each of the jaw assemblies comprises a replaceable die.

6. The assembly of claim 1, wherein each of the jaw assemblies comprises at least one upset feature to engage a helical groove of the chuck ring.

7. The assembly of claim 6, wherein the helical groove of the chuck ring simultaneously drives each of the plurality of jaw assemblies toward the axis of the main body as the chuck ring is rotated in the first direction.

8. The assembly of claim 6, wherein a first upset feature corresponds to a first range of sizes of tubular member, and a second upset feature corresponds to a second range of sizes of tubular member.

9. The assembly of claim 1, wherein each of the plurality of jaw assemblies comprises a jaw body, a carrier, and a die, the die comprising a plurality of hardened gripping teeth configured to retain an outer profile of a tubular within the main body.

10. The assembly of claim 9, wherein the jaw body and the carrier are integrally fowled together forming a solid slip, and the carrier is configured to receive the die.

11. A method to grip a tubular member with a gripping apparatus, the method comprising:

positioning the gripping apparatus, having a plurality of jaw assemblies in a plurality of cutouts of a main body of the gripping apparatus, substantially concentrically about a wellbore;

engaging the tubular member through a central bore of the gripping apparatus;

activating at least one rotation assembly to rotate a chuck ring of the gripping apparatus in a first direction;

simultaneously displacing the plurality of jaw assemblies radially toward the central bore with a helical groove of the chuck ring;

rotating the chuck ring until dies of each of the plurality of jaw assemblies engage an outer profile of the tubular member.

12. The method of claim 11, further comprising:

rotating the chuck ring of the gripping apparatus in a second direction; and simultaneously displacing the plurality of jaw assemblies radially away from the central bore with the helical groove of the chuck ring.

13. The method of claim 11, further comprising replacing a first plurality of jaw assemblies configured to engage a first range of tubular members with a second plurality of jaw assemblies configured to engage a second range of tubular members.

14. The method of claim 13, wherein the first range of tubular members comprises a plurality of tubulars of a specified range of diameters.

15. The method of claim 13, wherein the range of tubular members comprises a plurality of tubulars having a specified outer profile.

16. The method of claim 11, wherein each of the plurality of jaw assemblies comprises a jaw body, a carrier, and a die, the die comprising a plurality of hardened gripping teeth configured to retain an outer profile of a tubular within the main body.

17. The method of claim 16, wherein the jaw body and the carrier are integrally formed together forming a solid slip, and the carrier is configured to receive the die.

18. An assembly to grip a tubular member in a wellbore, the assembly comprising:

a main body comprising a chuck ring and at least one means for rotating the chuck ring;

a plurality of means for gripping the tubular member; and a cover plate to retain the plurality of means for gripping within the main body, wherein the main body further comprises a plurality of means for receiving each of the plurality of means for gripping the tubular;

wherein the plurality of means for gripping the tubular are configured to simultaneously engage the tubular member as the chuck ring is rotated in a first direction about an axis of the main body by the means for rotating.

19. The assembly of claim 18, wherein the plurality of means for gripping the tubular are configured to simultaneously disengage the tubular member as the chuck ring is rotated in a second direction about the axis of the main body by the means for rotating.

20. The assembly of claim 18, wherein each of the means for gripping the tubular comprises at least one means for engaging a helical groove of the chuck ring.

21. The assembly of claim 20, wherein the helical groove of the chuck ring simultaneously drives each of the plurality of means for gripping the tubular toward the axis of the main body as the chuck ring is rotated in the first direction.

22. The assembly of claim 20, wherein a first means for engaging corresponds to a first range of sizes of tubular member, and a second means for engaging corresponds to a second range of sizes of tubular member.

23. The assembly of claim 18, wherein each of the plurality of means for gripping the tubular member comprises a jaw body, a carrier, and a die, the die comprising a plurality of hardened gripping teeth configured to retain an outer profile of a tubular within the main body.

24. The assembly of claim 23, wherein the jaw body and the carrier are integrally formed together forming a solid slip, and the carrier is configured to receive the die.

25. An assembly to grip a tubular member in a wellbore, the assembly comprising:

a main body comprising a chuck ring and at least one rotation assembly;

a plurality of jaw assemblies, wherein each of the jaw assemblies comprises at least one upset feature to engage a helical groove of the chuck ring, and wherein a first upset feature corresponds to a first range of sizes of tubular member, and a second upset feature corresponds to a second range of sizes of tubular member; and a cover plate to retain the plurality of jaw assemblies within the main body;

wherein the plurality of jaw assemblies are configured to simultaneously engage the tubular member in the wellbore as the chuck ring is rotated in a first direction about an axis of the main body by the at least one rotation assembly.

26. The assembly of claim 25, wherein the helical groove of the chuck ring simultaneously drives each of the plurality of jaw assemblies toward the axis of the main body as the chuck ring is rotated in the first direction.

27. An assembly to grip a tubular member in a wellbore, the assembly comprising:

a main body comprising a chuck ring and at least one means for rotating the chuck ring;

a plurality of means for gripping the tubular member, wherein each of the means for gripping the tubular comprises at least one means for engaging a helical groove of the chuck ring, and wherein a first means for engaging corresponds to a first range of sizes of tubular member, and a second means for engaging corresponds to a second range of sizes of tubular member; and a cover plate to retain the plurality of means for gripping within the main body;

wherein the plurality of means for gripping the tubular are configured to simultaneously engage the tubular member as the chuck ring is rotated in a first direction about an axis of the main body by the means for rotating.

28. The assembly of claim 27, wherein the helical groove of the chuck ring simultaneously drives each of the plurality of means for gripping the tubular toward the axis of the main body as the chuck ring is rotated in the first direction.

* * * * *